United States Patent [19]

Cooper

[11] 3,958,805

[45] May 25, 1976

[54] RACKET YOKE

[75] Inventor: Adrianus A. G. Cooper, Alliance, Ohio

[73] Assignee: The Babcock & Wilcox Company, New York, N.Y.

[22] Filed: July 22, 1975

[21] Appl. No.: 598,081

[52] U.S. Cl. ..... 273/73 G

[51] Int. Cl.[2] ..... A63B 49/00

[58] Field of Search ..... 273/73 R, 73 C, 73 D, 273/73 F, 73 G, 73 H

[56] References Cited

UNITED STATES PATENTS

| | | | |
|---|---|---|---|
| 3,664,669 | 5/1972 | Latham et al. | 273/73 D |
| 3,702,701 | 11/1972 | Vaughn et al. | 273/73 D X |
| 3,884,467 | 5/1975 | Sommer | 273/73 H X |
| 3,908,995 | 9/1975 | Portz | 273/73 G |

FOREIGN PATENTS OR APPLICATIONS

| | | | |
|---|---|---|---|
| 550,985 | 12/1922 | France | 273/73 D |
| 1,920,584 | 11/1969 | Germany | 273/73 D |
| 1,201,649 | 8/1970 | United Kingdom | 273/73 D |

*Primary Examiner*—Richard J. Apley
*Attorney, Agent, or Firm*—Joseph M. Maguire; Vincent M. Fazzari

[57] ABSTRACT

A two-piece throat for a racket, the throat being formed with stringholes of slight curvature so as to reduce the occurrence of string failure. The throat comprises two substantially identical sections which fit together in a complementary manner to form the stringholes and provide a mechanical lock such that the force exerted by the strings on the stringhole walls is displaced from the interfaces of the two halves forming the throat.

5 Claims, 3 Drawing Figures

RACKET YOKE

BACKGROUND OF THE INVENTION

There are any number of popular games which employ a stringed racket or similar batting instruments for use in propelling a ball or birdie or the like. In each case, the racket is used to change the direction of the projectile and must absorb the momentum possessed by the projectile in flight. The force associated with striking the projectile temporarily elongates the racket strings causing them to slide over corners such that the strings eventually wear and fail. This is due to the fact that the stringholes in the yoke or throat of the racket are commonly produced by a punching or drilling process leaving sharp inner corners inaccessible to finishing procedures.

A solution of the problem has heretofore been unavailable as reference to the prior art will disclose. An attempt to minimize the effects of the corners is shown by Vaughn et al in their U.S. Pat. No. 3,702,701 Vaughn et al approaches the problem by placing raised portions or fillets or curved support surfaces on the throat adjacent the point where each string enters the throat as the string is directed to the racket frame. The possible disadvantage of this approach is that the curved support surface of necessity can only employ small radii because a structure with a larger radius would be esthetically lacking which is a drawback in such a market.

SUMMARY OF THE INVENTION

The present invention is directed to a new and improved two piece throat with stringholes of slight curvature which are formed when the two component sections of the throat are fitted together. The pieces fit together and form a mechanical locking configuration such that the interfaces or seams of the interlock are displaced from the plane of action of the string, thus reducing the tendency of the throat halves to separate.

It is a primary objective of the present invention to provide a yoke or throat for a tennis racket which gives improved string durability as well as tending to minimize differences in the string tension of the various strings.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF THE PREFERRED EMBODIMENT

Figure 1:
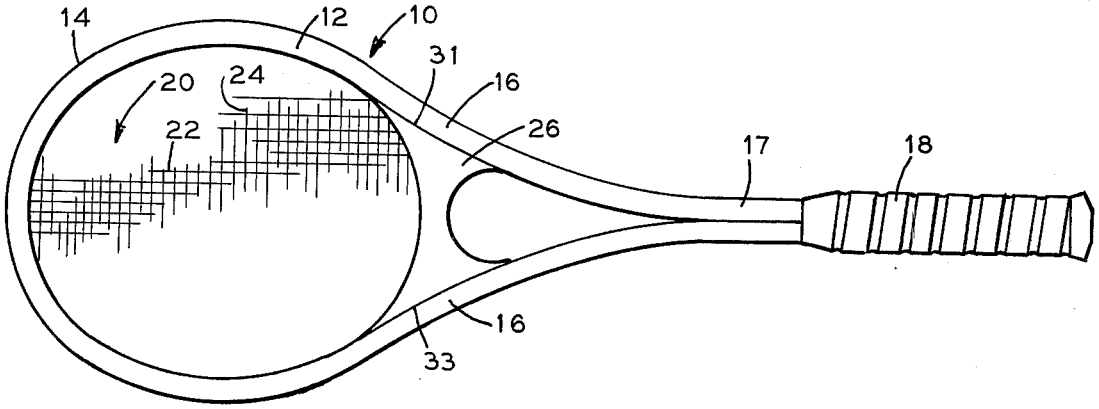
FIG. 1 generally depicts a popular style of tennis racket and shows how the present invention would appear in the racket.

FIG. 1 generally depicts a tennis racket 10 of popular style and construction which incorporates the present invention as a component thereof. Racket 10 comprises a frame 12 which is the basic component of the racket and the primary load carrying structure. The frame 12 as shown generally depicts a popular shape which tennis enthusiasts find esthetically pleasing. The frame may be constructed of a ferrous or non-ferrous metal as well as wood, or a fiber reinforced composite such as a glass or graphite reinforced thermoset or thermoplastic. The uppermost portion of the frame is referred to as the bow or trebling and is designated as 14. The sloping portions of the frame are the shoulders 16. Shoulders 16 close to handle area 17, the end of which is encased by grip 18. Grip 18 may be of lightweight foam material such as polyurethane.

The frame surrounds face 20 of the racket and a throat 26 which is adhesively secured to shoulders 16. Face 20 is comprised of the main or long strings 22 and the cross or short strings 24. These strings can be made of nylon, catgut or steel and may be attached to the frame by the use of grommets (not shown) in a manner well known in the art. The strings are maintained in a highly tensed condition providing the face with a rigid grid-like quality. A number of the main strings 22 will travel the entire length of the face which necessitates connection to the frame 12 in the shoulder section. 16. As such, strings must pass through throat 26. The strings are then directed toward the shoulders 16 of frame 12 wherein they are secured.

Figure 2:
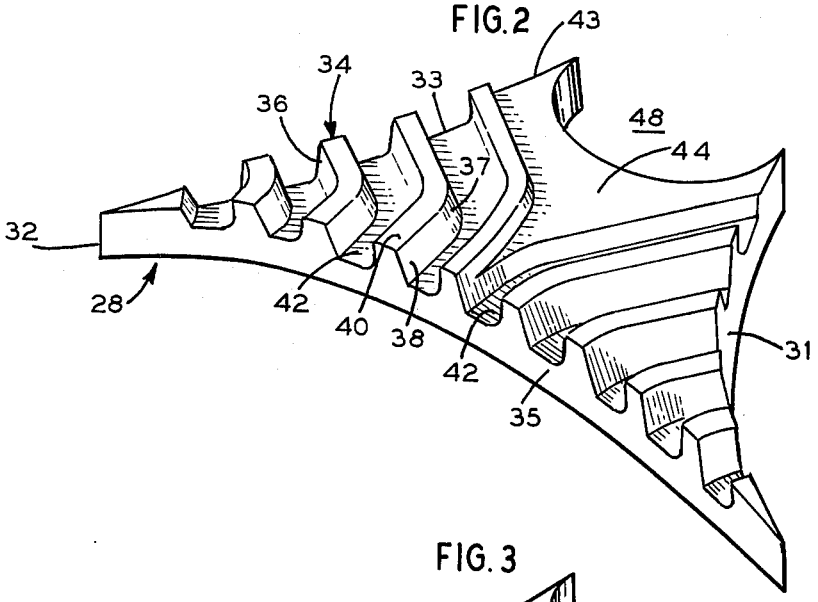
FIG. 2 shows a perspective view of one of the complementary portions of the throat.
Figure 3:
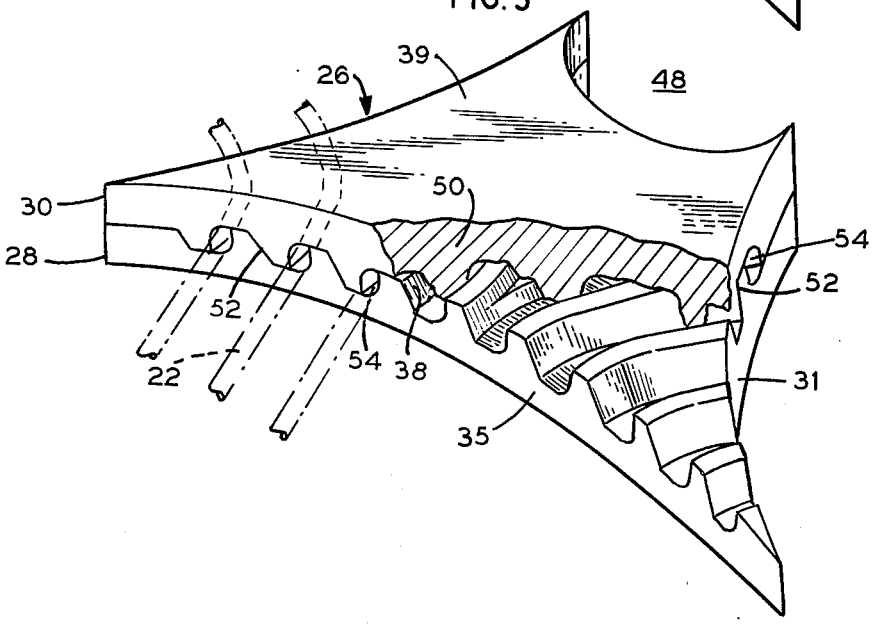
FIG. 3 shows a perspective view of the assembled throat with a number of strings penetrating the throat as well as a partial cutaway to show how the complementary components fit together to form the mechanical lock.

Throat 26 comprises two identical sections 28 and 30 which fit together in a complementary manner to form stringholes. With reference to FIGS. 2 and 3, each throat section includes slightly concave side surfaces 31 and 33 which conform in curvature to and contact the shoulders 26 of the frame, a concave front surface 35 cooperating with the frame to form an oval string section for the racket, a semi-circular rear surface 48 opening in the direction of the handle, and a flat outer surface 39. Each throat section has its inner surface formed with round-cornered or crooked grooves 42 to provide round-cornered or crooked ribs 34 of trapezoidal cross-section intermediate the grooves. The grooves and the ribs are arranged in a symmetrical pattern on opposite sides of the longitudinal axis of throat 26, the grooves and ribs on one side of the axis extending parallel to each other form front surface 35 to side surface 31, the grooves and ribs on the opposite side of the axis extending parallel to each other from front surface 35 to side surface 33.

Each rib 34 includes a curved sloping side 36 and a straight sloping side 38 joined by a top section 40 which extends substantially parallel to outer surface 39. Consecutive ribs, which grow longer in length in the direction of the center of each throat section, form grooves 42. Grooves 42 are narrowest at the base of the ribs. At their narrowest point, the grooves are about twice as wide as the narrowest section of the ribs which is at top sections 40. The rear portion of the inner surface of each throat section has a raised plateau 44 which is approximately one-half of the thickness of the assembled throat 26. The raised plateau 44 serves as a transition piece as regards the direction of curvature of the grooves 42 near the center of each throat section. Plateau 44 is formed with semi-circular surface 48 so as to reduce unnecesssary air resistance when the racket 10 (FIG. 1) is being used.

FIG. 3 shows a perspective view of the assembled throat 26, with a section partially cut away to show how components 28 and 30 fit together. The pattern and location of the ribs and grooves of throat section 28 are arranged so as to fit the ribs and grooves of throat section 30 in a complementary manner to form a mechanical lock along interfaces 52. So when assembled rib sides 38 and tops 40 of each throat section are respectively in contact with the corresponding rib sides and part of the transverse extent of grooves 42 of the other throat section, while rib sides 36 and the remaining part of the grooves cooperate to form stringholes 54. Each stringhole 54 originates at concave face 35 and terminates either at side surface 31 or 33. It is from side surfaces 31 or 33 that strings 22 will be attached to frame 12 through grommets (not shown) in a conventional manner. Such an arrangement allows the strings 22 to exit throat 26 perpendicular or nearly perpendicular to shoulder 16 to minimize wear and tear on the strings 22 and frame 12. As such, the throat 26 is itself a part of the primary load carrying structure and helps in distributing the load to the frame 12.

In accordance with the invention, interfaces 52 are displaced from the horizontal and vertical center lines of the stringholes so that any thrust experienced by the strings is not transmitted directly to the interfaces, but rather is buttressed by rib sides 36. As such, there is no tendency for the seams to be split open since the thrust is transmitted to rib sides 38. Due to the sloping surfaces, there is a larger gently rounded contact surface area over which the thrust can be dissipated thus minimizing wear on the strings.

The throat sections 28 and 30 can be made from a variety of materials in a variety of ways. As such, the throat sections can be injection molded, compression molded, forged or cast, using thermoplastics, thermoset or metals. The thermoplastics and thermosets can be fiber reinforced. The throat sections are preferably ultrasonically welded together but it has been found that epoxy based adhesives can also be used.

It should be observed that grooves and thus the stringholes can have a number of varying patterns ranging from completely curvilinear to the crooked or rounded corner arrangement as well as combinations of curvilinear and rectilinear.

The embodiments of the invention in which an exclusive property or privilege is claimed are defined as follows:

1. A throat for a racket, which comprises two sections each having its inner surface formed with a plurality of crooked grooves to provide a plurality of crooked ribs intermediate the grooves, the ribs of each throat section being constructed and arranged to interlock with and contact the ribs and part of the transverse extent of the grooves of the other throat section and cooperate with the remaining part of the grooves to form stringholes through the throat.

2. A throat as in claim 1, wherein each section includes side surfaces and a front surface, the groove and ribs are arranged in a symmetrical pattern on opposite sides of the longitudinal axis of the throat, the grooves and ribs on one side of the axis extending from the front surface to one of the side surfaces, the grooves and ribs on the opposite side of the longitudinal axis extending from the front surface to the other side surface.

3. A throat as in claim 2, wherein the ribs are trapezoidal in cross section.

4. A throat as in claim 2, wherein the ribs and grooves on the one side of the longitudinal axis extend parallel to each other, and the ribs and grooves on the opposite side of the axis extend parallel to each other.

5. In combination with a racket having a frame with shoulders connected to a handle and strings stretched in the frame, an improved throat for the racket, the throat comprising two sections, each section having side surfaces which conform in curvature to and contact the frame shoulders, a concave front surface cooperating with the frame to form the string section, and an inner surface formed with a plurality of crooked grooves to provide a plurality of crooked ribs intermediate the grooves, the grooves and ribs being arranged in a symmetrical pattern on opposite sides of the longitudinal axis of the throat, the grooves and ribs on one side of the axis extending parallel to each other from the front surface to one of the side surfaces, the grooves and ribs on the opposite side of the axis extending parallel to each other from the front surface to the other side surface, the ribs of each throat section contacting the ribs and part of the transverse extent of the grooves of the other throat section and cooperating with the remaining part of the grooves to form holes through which strings are passed for securement to the frame.

* * * * *